US005854197A

United States Patent [19]

Duccini et al.

[11] Patent Number: 5,854,197

[45] Date of Patent: Dec. 29, 1998

[54] CLEANING COMPOSITIONS CONTAINING LIME-SOAP DISPERSANT AND METHOD OF PREPARATION

[75] Inventors: Yves Duccini, Beauvais, France; Andrea Claudette Keenan, Plymouth Meeting; Jan Edward Shulman, Newtown, both of Pa.

[73] Assignee: Rohm and Haas Company, Philadelphia, Pa.

[21] Appl. No.: 720,497

[22] Filed: Sep. 30, 1996

[30] Foreign Application Priority Data

Oct. 13, 1995 [FR] France ..... 95 12038

[51] Int. Cl.[6] ..... C11D 3/37; C11D 3/12

[52] U.S. Cl. ..... 510/434; 510/437; 510/447; 510/448; 510/450; 134/25.2

[58] Field of Search ..... 510/430, 434, 510/450, 445, 446, 448, 437, 447; 134/25.2

[56] References Cited

U.S. PATENT DOCUMENTS

| | | | |
|---|---|---|---|
| 4,265,778 | 5/1981 | Sonentein | 252/117 |
| 4,797,223 | 1/1989 | Amick et al. | 252/174 |
| 4,891,149 | 1/1990 | Nagarajan et al. | 252/110 |
| 5,126,068 | 6/1992 | Burke et al. | 252/174 |
| 5,232,622 | 8/1993 | Jones et al. | 252/174 |

FOREIGN PATENT DOCUMENTS

| | | |
|---|---|---|
| 0 147 745 A2 | 7/1985 | European Pat. Off. . |
| 0 630 965 A1 | 12/1994 | European Pat. Off. . |

*Primary Examiner*—Paul Lieberman
*Assistant Examiner*—Necholus Ogden
*Attorney, Agent, or Firm*—Carole A. Davis; Thomas J. Howell

[57] ABSTRACT

Cleaning compositions containing a lime-soap dispersant and a method of preparing liquid cleaning compositions containing lime-soap dispersants are disclosed. More specifically, cleaning compositions containing lime-soap dispersant polymers derived from maleic acid, maleic anhydride, or salts thereof, copolymerized with a hydrophobic monomer containing from 4 to 20 carbon atoms are disclosed. Cleaning compositions containing a lime-soap dispersant based on maleic acid/diisobutylene polymers are particulary effective in producing stable liquid cleaning compositions with good lime-soap dispersancy properties.

11 Claims, No Drawings

CLEANING COMPOSITIONS CONTAINING LIME-SOAP DISPERSANT AND METHOD OF PREPARATION

BACKGROUND

This invention relates to a process for formulating liquid detergent compositions having improved lime-soap dispersancy properties and the liquid cleaning compositions so formed. In particular the present invention relates to liquid cleaning compositions having improved lime-soap dispersancy that contain copolymers formed from maleic acid, maleic anhydride, or salts thereof, and a copolymerizable hydrophobic monomer, oligomer or polymer, containing from 4 to 20 carbon atoms.

The use of soap as a cleaning agent is well known. Among its deficiencies, soap is known to form insoluble salts in water in the presence of calcium and magnesium ions (hard water). In hard water the insoluble salts flocculate to form "lime scum" or "lime-soap" deposits, which transfer onto clothing or fabrics ("graying up") which have been washed or onto container surfaces ("bath tub ring") in which washing or rinsing of clothing or fabrics is performed.

It is desirable to prevent the deposition of lime-soap and this has been achieved by the addition of synthetic detergents or surfactants as lime-soap dispersants to cleaning formulations to prevent or minimize the flocculation of the insoluble lime-soap particles; the dispersed lime-soap remains in a finely divided state so that it does not adhere to surfaces and can be washed away during rinsing. However, large amounts of synthetic detergents or surfactants are required to provide effective dispersion of lime-soap and add to the cost of cleaning formulations.

It has also been recognized that the use of sequestering agents, for example, citrates, phosphates or polyphosphates, to form metal complexes with calcium or magnesium, may prevent the formation of lime-soap particles. The desirability of avoiding phosphates in detergents is well recognized; phosphorus-based compounds when present in lakes, rivers, and bays, serve as nutrients for algae growth, resulting in the deterioration of water quality. It is, therefore, desirable to minimize lime-soap formation or deposition on washed fabrics or surfaces without adding significantly to the cost of cleaning formulations, without contributing to environmental pollution and without destabilizing or affecting other properties of the cleaning formulations.

Among the approaches used to solve the lime-soap problem in cleaning compositions are the following. U.S. Pat. No. 4,797,223 discloses the use of acrylic acid polymers partially esterified with polyoxyalkylene ethoxylates as lime-soap dispersants in heavy duty liquid laundry and dishwashing compositions. EP 147745A discloses the use of polyalkyleneglycol esterified acrylic acid polymers and corresponding acrylamidoalkanesulfonic acid copolymers as lime-soap dispersants in cleaning compositions. These materials cover a range of efficiency as lime-soap dispersants and have different levels of compatibility with certain cleaning formulation ingredients.

The following references disclose the use of maleic acid/olefin copolymers in various cleaning compositions. U.S. Pat. No. 5,126,068 discloses the use of polyoxylalkylene block copolymer surfactants in combination with certain polycarboxylate copolymers (including maleic acid/olefin copolymers) in solvent-containing hard surface cleaning compositions. U.S. Pat. No. 5,232,622 discloses the use of maleic acid/olefin copolymers as dispersants in chlorine-free machine-dishwashing compositions. EP 630965A discloses the use of maleic acid/olefin copolymers as crystallization inhibitors in concentrated liquid hard-surface cleaning compositions.

The problem addressed by the present invention is to overcome the deficiencies of prior lime-soap dispersants and to provide a method for the formulation of liquid cleaning compositions having enhanced lime-soap dispersancy properties while maintaining good physical storage stability.

STATEMENT OF INVENTION

The present invention provides a method for preparing a liquid cleaning composition comprising combining (a) from 0.05 to 10 percent, based on total cleaning composition weight, of a lime-soap dispersant polymer comprising as polymerized units from 20 to 90 percent, based on total polymer weight, of maleic acid monomer selected from one or more of maleic acid, maleic anhydride and water-soluble salts thereof, and from 10 to 80 percent, based on total polymer weight, of a hydrophobe containing from 4 to 20 carbon atoms and selected from one or more of alkenes, dienes, alkynes and aromatic compounds; (b) from 0.5 to 30 percent, based on total cleaning composition weight, of soap selected from one or more water-soluble salts of saturated and unsaturated ($C_8$–$C_{24}$) aliphatic carboxylic acids; (c) from 0.1 to 60 percent, based on total cleaning composition weight, of auxiliary additives selected from one or more stabilizers, builders, and water-soluble anionic and non-ionic surfactants; and (d) water; adjusting the pH of the liquid cleaning composition to 5 to 11.5, maintaining the ratio of the lime-soap dispersant polymer to the soap from 1/1 to 1/200 by weight; and selecting the relative proportions of the lime-soap dispersant polymer, the soap, the auxiliary additives and the water in steps (a) through (d) such that the liquid cleaning composition is stable.

The present invention also provides liquid cleaning compositions comprising from 0.05 to 10 percent, based on total cleaning composition weight, of a lime-soap dispersant polymer as described above, from 0.5 to 30 percent, based on total cleaning composition weight, of soap as described above, and water; wherein the pH of the liquid cleaning composition is 5 to 11.5, the ratio of the lime-soap dispersant polymer to the soap is from 1/1 to 1/200 by weight; and wherein relative proportions of the lime-soap dispersant polymer, the soap, the auxiliary additives and the water are selected such that the liquid cleaning composition is stable.

The present invention further provides solid cleaning compositions comprising from 0.05 to 10 percent, based on total cleaning composition weight, of a lime-soap dispersant polymer as described above, from 0.5 to 50 percent, based on total cleaning composition weight, of soap as described above and from 20 to 80 percent, based on total cleaning composition weight, of auxiliary additives selected from one or more neutral salts, builders, and water-soluble anionic and non-ionic surfactants.

The present invention further provides a method for cleaning soiled materials comprising contacting a soiled material with the cleaning compositions as described above in an aqueous medium until substantial removal of soil is accomplished.

DETAILED DESCRIPTION

The liquid cleaning compositions of the present invention can be formulated by the inclusion of lime-soap dispersant (LSD) polymers containing as polymerized units a maleic acid monomer and a hydrophobe. "Liquid," as used herein, refers to a solution, a gel or a slurry. "Maleic acid monomer,"

as used herein, refers to maleic acid, maleic anhydride, or water-soluble salts thereof. "Hydrophobe," as used herein, refers to a monomer, oligomer, or polymer, which is copolymerized with maleic acid monomer and is more hydrophobic than the maleic acid monomer. The hydrophobe contains at least 4 carbon atoms, preferably from 4 to 20 carbon atoms and more preferably from 6 to 10 carbon atoms. The hydrophobe can be at least one monomer selected from one or more of alkenes, dienes, alkynes and aromatic compounds. Examples of suitable hydrophobes include, for example, isobutylene, diisobutylene, styrene, decene, limonene, linalool and eicosene. Preferred hydrophobes are diiso-butylene, styrene, linalool and limonene. Water-soluble salts of the polymers, for example, the alkali metal salts (such as sodium or potassium), and the ammonium or substituted ammonium salts thereof, can also be used.

The LSD polymers useful in the present invention can be prepared by methods of polymerization well known to those skilled in the art. They can be prepared by aqueous, solvent or emulsion polymerization; preferably they are prepared by solvent polymerization. The amount of maleic acid monomer contained in the polymer is from 20 to 90 percent (%), preferably from 25 to 75% and more preferably from 30 to 60% based on weight of the polymer. The amount of hydrophobe contained in the polymer is from 10 to 80%, preferably from 25 to 75% and more preferably from 40 to 70% based on weight of the polymer. A preferred polymer composition is 50% maleic acid and 50% diisobutylene based on weight of the polymer. It has been found that the performance of the polymer used in the present invention is not dependent upon its molecular weight, provided that the molecular weight of the polymer does not adversely affect its compatibility with other components of the cleaning compositions. Weight average molecular weights ($M_w$) of the polymers of the present invention are typically from 1,000 to 50,000, preferably from 2,000 to 20,000, and more preferably from 3,000 to 15,000, as measured by aqueous gel permeation chromatography (GPC).

The amount of LSD polymer used in preparing liquid cleaning compositions of the present invention can vary depending upon the intended use of the cleaning compositions and is dependent on the amounts of other components which have an impact on desired performance characteristics, for example, composition stability and cleaning effectiveness. The amount of LSD polymer used will generally be from 0.05 to 10%, preferably from 0.05 to 6% and more preferably from 0.1 to 4% by weight of the liquid cleaning compositions. Unless indicated otherwise, liquid cleaning compositions include, for example, laundry, hand soap (personal care), machine-dishwashing and hand-dish-washing compositions.

The weight ratio of LSD polymer/soap in cleaning compositions of the present invention can vary depending upon the intended use of the cleaning compositions and the need to maintain compatibility with other components of the cleaning compositions. The LSD polymer/soap weight ratio will generally be from 1/1 to 1/200, preferably from 1/2 to 1/100, more preferably from 1/2 to 1/50 and most preferably from 1/2 to 1/20.

As used herein, "soap" refers to salts of long chain fatty acids. Soaps useful in the present invention include water-soluble salts of saturated and unsaturated ($C_8$–$C_{24}$)aliphatic carboxylic acids, for example, the alkali metal (such as sodium or potassium), and ammonium salts. Particularly useful are the sodium and potassium salts of ($C_{10}$–$C_{18}$) aliphatic carboxylic acids. Soaps derived from one or more of tallow or palms oils, such as ($C_{16}$–$Cl_8$)aliphatic carboxylic acid residues, and coconut or palm kernel oils, such as ($C_{10}$–$C_{14}$)aliphatic carboxylic acid residues, are preferred forms of soap useful in the present invention.

The amount of soap used in preparing cleaning compositions of the present invention can vary depending upon the physical form and intended use of the cleaning compositions. The amount of soap used will generally be from 0.5 to 30%, preferably from 5 to 30% and more preferably from 12 to 20% by weight of liquid laundry compositions; from 0.5 to 30% and preferably from 0.5 to 10% by weight of liquid hand soap (personal care) compositions; and from 0.5 to 10% and preferably from 0.5 to 5% by weight of liquid machine-dishwashing or liquid hand-dishwashing compositions.

Cleaning compositions of the present invention also contain auxiliary additives, the selection of which are dependent upon the physical form and intended use of the cleaning compositions. For example, auxiliary additives used in solid cleaning compositions (discussed in further detail later), are neutral salts, builders, and water-soluble anionic and non-ionic surfactants. For liquid cleaning compositions, these auxiliary additives are selected from one or more stabilizers, builders, and water-soluble anionic and non-ionic surfactants and the quantities used will generally be from 0.1 to 60% and preferably from 10 to 40% by weight of the liquid cleaning composition.

Stabilizers (also referred to as compatiblizers, solubilizers or hydrotropes) useful in the present invention include, for example, alcohols (such as ethanol, n-propanol and isopropanol), propylene glycol, glycol ethers, monoethanolamine, diethanolamine, triethanolamine, xylenesulfonate, cumenesulfonate and toluene-sulfonate. The amount of stabilizer used in liquid cleaning compositions will depend on the other components of the composition and will generally be from 0 to 30% and preferably from 2 to 20% by weight of liquid laundry or liquid hand soap (personal care) compositions; and from 0 to 20%, preferably from 0.1 to 10%, by weight of liquid machine-dishwashing or liquid hand-dishwashing compositions.

Builders useful in the present invention include, for example, inorganic builder salts such as alkali metal polyphosphates (such as tripolyphosphates and pyrophosphates); ethylenediaminetetraacetic acid, nitrilotriacetate, alkali metal carbonates, borates, bicarbonates and hydroxides; zeolites; water-soluble organic builders such as citrates, polycarboxylates and carboxylates; and monomeric (for example, aminotrismethylenephosphonic acid, hydroxyethanediphosphonic acid, diethylenetriaminepenta (methylenephosphonic acid), ethylenediaminetetraethylenephosphonic acid and salts thereof), oligomeric and polymeric phosphonates. The amount of builder used will generally be from 0 to 50%, preferably from 0 to 30% and more preferably from 0 to 15% by weight of liquid cleaning compositions; for liquid machine-dishwashing compositions the amount of builder typically will be 30 to 50% by weight. When builders having limited water-solubility are used (for example, tripolyphosphates, carbonates, bicarbonates and zeolites) the liquid cleaning composition may be in the form of a stable opaque slurry depending upon the concentration of builder used. Liquid cleaning compositions of the present invention are preferably phosphate-free.

Anionic surfactants useful in the present invention include, for example, ($C_{10}$–$C_{16}$)alkylbenzenesulfonates, particularly linear ($C_8$–$C_{12}$)alkylbenzene-sulfonates, such as sodium dodecylbenzenesulfonate; ($C_{12}$–$C_{16}$)alcohol sulfates, ethoxylated ($C_{12}$–$C_{16}$)alcohol sulfates, hydroxy alkylsulfonates, ($C_{12}$–$C_{16}$)alkenyl-and ($C_{12}$–$C_{16}$) alkylsulfates and sulfonates, monoglyceride sulfates, ($C_{12}$–$C_{16}$)alkyl sulfosuccinates, and acid condensates of fatty acid chlorides with hydroxy alkylsulfonates.

Nonionic surfactants useful in the present invention include, for example, alkylene oxide (such as ethylene oxide) condensates of: mono- and polyhydroxy alcohols, ($C_6$–$C_{12}$)alkyl phenols, fatty acid amides, and fatty amines; amine oxides, sugar derivatives such as sucrose monopalmitate, glucamine, long chain tertiary phosphine oxides, dialkyl sulfoxides, and fatty acid amides (such as mono- or diethanol amides of fatty acids containing 10 to 18 carbon atoms).

The combined quantity of non-ionic and anionic surfactant used in liquid cleaning compositions will depend on the surfactants chosen and will generally be from 10 to 50%, preferably from 12 to 40% and more preferably from 15 to 30%, by weight of liquid laundry or liquid hand-dishwashing compositions; and from 0.1 to 10% and preferably from 0.2 to 5% by weight of liquid hand soap (personal care) or liquid machine-dishwashing compositions. The combined amount of non-ionic and anionic surfactants in liquid cleaning compositions may be all of one type, that is, all non-ionic or all anionic surfactant.

The combined amount of soap and other types of surfactants (for example, non-ionic and anionic surfactants) used in liquid cleaning compositions of the present invention will generally be from 10 to 70%, preferably from 12 to 60% and more preferably from 15 to 50% by weight of the liquid cleaning compositions.

The amount of water used in preparing liquid cleaning compositions of the present invention can vary depending upon the intended use of the cleaning compositions and is dependent upon the desired final concentrations of LSD polymer, soap and other components in the cleaning solution. The amount of water typically used will be from 10 to 80% and preferably from 40 to 70% by weight of liquid cleaning compositions.

Optional modifying additives may also be used along with LSD polymers, soaps and auxiliary additives in liquid cleaning compositions of the present invention. These optional modifying additives include, for example, additional water-soluble surfactants, neutral salts, corrosion inhibitors, bleaching agents, enzymes, anti-redeposition agents, optical brighteners, colorants, softeners, preservatives, opacificers, dye-transfer inhibitors, buffer agents, perfumes and bactericides. The quantity of optional modifying additives used will generally be from 0 to 30% and preferably from 0 to 15% by weight of the liquid cleaning composition.

Additional water-soluble surfactants useful in the present invention include, for example, zwitterionic, amphoteric and cationic surfactants and combinations thereof. Zwitterionic surfactants include, for example, aliphatic quaternary ammonium compounds such as 3-(N,N-dimethyl-N-hexadecyl-ammonio)propane-1-sulfonate and 3-(N,N-dimethyl-N-hexadecylammonio)-2-hydroxypropane-1-sulfonate. Amphoteric surfactants include, for example, betaines, sulfobetaines and fatty acid imidazole carboxylates and sulfonates. Cationic surfactants include, for example, ($C_{16}$–$C_{18}$)dialkyldimethylammonium chlorides and ($C_8$–$C_{18}$)alkyl-dimethylbenzylammonium chlorides.

Neutral salts include, for example, alkali metal chlorides, sulfates, nitrates and nitrites, as optional modifying additives and may be used in amounts ranging from 0 to 10% and preferably from 0 to 5% by weight of liquid cleaning compositions.

Corrosion inhibitors useful in the present invention include, for example, sodium silicate, sodium disilicate and sodium metasilicate and are used in liquid cleaning compositions in amounts ranging from 0 to 20% and preferably from 0 to 10% by weight, particularly in liquid machine-dishwashing formulations. Bleaching agents useful in liquid cleaning compositions include, for example, chlorine-generating substances, such as sodium hypochlorite and chloroiso-cyanurates.

LSD can be used in soap or detergent cleaning formulations and they serve different purposes in each. Soap-containing cleaning formulations depend on LSD to prevent the buildup of lime-soap deposits in tubs and basins in the presence of hard water. Detergent cleaning formulations (containing one or more anionic and nonionic surfactants, but little or no soap) depend on LSD to dislodge and suspend lime-soap deposits that are not readily removed from soiled materials by other detergent formulation components, thus enhancing the "whiteness" of the washing process.

"Lime-soap dispersancy power" or LSDP measures the ability of a material to disperse lime-soap deposits, using calcium oleate as a model lime-soap. LSDP is expressed as a percentage and refers to the minimum amount of a material required to disperse a given amount of lime-soap deposit under standard conditions (see description in Examples 1–8). A material with a lower LSDP value is a more effective LSD than a material with a higher LSDP. LSDP values for LSD polymers of the present invention are typically less than 30, preferably less than 20, and more preferably less than 15. Low values of LSDP mean that relatively small amounts of a LSD polymer need to be added to a cleaning formulation to satisfy overall cleaning requirements and that there is a greater likelihood that the resultant composition will be stable, that is, there is a lower probability that the components of the cleaning composition will be incompatible.

The method of the present invention provides the preparation of stable liquid cleaning compositions, that is, they remain physically stable upon storage and do not settle, separate or precipitate into different phases. The components of the liquid cleaning compositions and their relative proportions are selected such that they are compatible with each other resulting in stable liquid formulations. In general, satisfactory compatibility of the LSD polymer with the liquid cleaning formulation is indicated if greater than 1%, preferably greater than 2% and more preferably greater than 3% by weight of the LSD polymer can be added to the liquid cleaning formulation while maintaining stability.

Liquid cleaning compositions of the present invention are typically prepared by adding the LSD polymer to a mixture of cleaning composition components. The LSD polymer and cleaning composition components are not combined in any particular order; however, it is preferable to dissolve any solid components first in water, adjust the pH, combine with liquid components, and finally adjust to the desired pH, if needed. Aqueous solutions of cleaning compositions of the present invention typically have a pH ranging from 5 to 11.5, preferably from 7 to 10 and more preferably from 7.5 to 9.

The LSD polymers used in the method of the present invention for the preparation of liquid cleaning compositions can also be used for formulating solid cleaning compositions. Physical forms of solid cleaning compositions include, for example, powders, granules, flakes, tablets and bars; when the cleaning compositions are in solid form they must be substantially soluble in the aqueous media used to wash or clean soiled materials.

The amount of LSD polymer used in preparing solid cleaning compositions will generally be from 0.05 to 10% and preferably from 0.25 to 4% by weight of the solid cleaning compositions. Unless indicated otherwise, solid cleaning compositions include, for example, powder laundry, bar soap laundry, personal care bar soap and powder machine-dishwashing compositions.

The amount of soap used in preparing solid cleaning compositions will generally be from 0.5 to 30% and preferably from 8 to 20% by weight of powder and bar soap laundry compositions; from 0 to 50% and preferably from 10 to 30% by weight of personal care bar soap compositions; and from 0.5 to 5%, preferably from 0.5 to 3%, by weight of powder machine-dishwashing compositions.

Solid cleaning compositions of the present invention also contain auxiliary additives. These auxiliary additives are selected from one or more neutral salts, builders, and water-soluble anionic and non-ionic surfactants, and can vary in amounts depending upon the physical form and intended use of the solid cleaning compositions; the quantity of auxiliary additives used will generally be from 20 to 80% and preferably from 30 to 60% by weight of the solid cleaning composition.

Neutral salts (described above) are used as inert diluents in solid cleaning compositions. Examples of such diluents include, for example, sodium or potassium chloride, sodium or potassium sulfate and sodium or potassium nitrite; calcium carbonate may be used as inert filler in bar soap laundry compositions. The amount of neutral salts used is typically from 0 to 60% and preferably from 0 to 30% based by weight of solid cleaning compositions.

The amount of builder (described above) used in solid cleaning compositions will generally be from 0 to 80% and preferably from 0 to 40% by weight of powder laundry compositions, for example, zeolite (such as sodium aluminosilicate) may be added in amounts from 0 to 50% and preferably from 20 to 40% by weight; from 10 to 40% by weight of bar soap laundry compositions; from 0 to 10% by weight of personal care bar soap compositions; and from 0 to 60%, preferably from 0 to 40%, by weight of powder machine-dishwashing compositions.

The combined quantity of non-ionic and anionic surfactant (described above) used in solid cleaning compositions will depend on the surfactants chosen and will generally be from 10 to 50% and preferably from 10 to 30% by weight of powder laundry, bar soap laundry and personal care bar soap compositions; and from 0.1 to 10%, preferably from 0.2 to 5%, by weight of powder machine-dishwashing compositions. The combined amount of non-ionic and anionic surfactants in liquid cleaning compositions may be all of one type, that is, all non-ionic or all anionic surfactant.

Solid cleaning compositions of the present invention may also contain water in the form of absorbed or entrained moisture. The amount of water typically will be from 0 to 10% and preferably from 0 to 5% by weight of the solid cleaning compositions.

Optional modifying additives may also be used along with LSD polymers, soaps and auxiliary additives in solid cleaning compositions of the present invention. These optional modifying additives include, for example, corrosion inhibitors (in amounts ranging from 0 to 40%, preferably from 0 to 20%, by weight in powder machine-dishwashing compositions; and from 0 to 12%, preferably from 0 to 6%, by weight in powder laundry compositions), bleaching agents such as perborates, percarbonates and calcium hypochlorite (in amounts ranging from from 0 to 30%, preferably from 0 to 20%, by weight in powder laundry compositions; and from 0 to 20%, preferably from 0 to 15%, by weight in powder machine-dishwashing compositions), additional water-soluble surfactants, enzymes, stabilizers, anti-redeposition agents, optical brighteners, colorants, softeners, preservatives, opacificers, dye-transfer inhibitors, buffer agents, perfumes and bactericides. The quantity of optional modifying additives that may be added to solid compositions will generally be from 0 to 50% and preferably from 0 to 30% by weight of the composition.

Only a small amount of the cleaning composition is typically required in aqueous media to achieve satisfactory cleaning of soiled materials. For example, from 0.01 to 0.5%, based on the combined weight of the cleaning composition and aqueous medium, is sufficient to provide satisfactory cleaning of lightly soiled clothing, fabrics and dishware; for highly soiled materials, from 0.5 to 1% of the cleaning composition in the aqueous medium can be used. "Soiled materials," as used herein, include for example soiled fabric, soiled clothing, soiled human body parts and soiled hard surfaces, such as dishware, floors, and walls.

Aqueous solutions of cleaning compositions of the present invention are effective for cleaning soiled materials over a wide range of wash water temperatures, typically from 5° to 95° C., preferably from 15° to 80° C. and most preferably from 25° to 60° C.

Some embodiments of the invention are described in detail in the following Examples. All ratios, parts and percentages (%) are expressed by weight unless otherwise specified, and all reagents used are of good commercial quality unless otherwise specified.

EXAMPLES 1–9

Lime-Soap Dispersancy Test

Using a procedure based on a test described by H. C. Borghetty and C. A. Bergman in J. Am. Oil Chem. Soc. 27, pp 88–90 (1950) the "lime-soap dispersancy power" (LSDP) of water-soluble polymers of the present invention was measured and compared to that of various acrylic acid and maleic acid polymers. The object of the test was to measure by visual means the minimum amount of a lime-soap dispersant (LSD) required to disperse a given amount of calcium oleate (model lime-soap) in very hard water. The results given in Table I indicate that the polymers of the present invention (Examples 4–8) are superior to comparative polymers based on acrylic acid homopolymer (Example 1), acrylic acid/maleic acid copolymer (Example 2) and maleic acid homopolymer (Example 3) in lime-soap dispersancy.

Lime-Soap Dispersancy Power (LSDP) is the percent weight ratio of lime-soap dispersant to sodium oleate required to disperse the lime-soap deposits formed by 0.025 grams of sodium oleate in 30 ml of water containing 333 ppm (parts per million by weight) of calcium carbonate ($Ca^{2+}/Mg^{2+}$=3/1) equivalent hardness. Five ml 0 of 0.5% by weight solution of sodium oleate was added to a test tube, followed by various amounts (less than 15 ml) of lime-soap dispersant as a 1% by weight solution (pH=7–10). A hard water solution (10 ml) containing 750 ppm $Ca^{2+}$ and 250 ppm $Mg^{2+}$ (1000 ppm as $CaCO_3$ equivalent) which caused formation of a lime-soap deposit was then added and the total volume of solution in the test tube was made up to 30 ml with deionized water. The test tube was stoppered, inverted 20 times and then allowed to stand for 30 seconds. The solutions were visually examined to determine if the lime-soap deposits were intact or whether they were dispersed into the solution. The test procedure was repeated using different amounts of lime-soap dispersant solution until a minimum amount of lime-soap dispersant solution that would disperse the lime-soap deposits was obtained. According to the test method described, a material with a lower LSDP value is a more effective lime-soap dispersant than a material with a higher LSDP. When two values for LSDP are listed in Table I, for example, 10–20, this means LSDP is greater than the first number (10) and less than the second number (20).

$$LSDP\ (\%) = \frac{[\text{weight of lime-soap dispersant}]}{[\text{weight of sodium oleate}]} \times 100$$

Abbreviations used in the Tables are listed below with the corresponding descriptions:

AA=Acrylic Acid

MAL=Maleic Acid

STY=Styrene

DIB=Diisobutylene

LIM=Limonene

LIN=Linalool

NA=Not Analyzed

TABLE I

| Example # | Polymer Composition | Polymer $M_w$ | LSDP | Compatibility |
|---|---|---|---|---|
| 1 (comp) | 100 AA | 4,500 | 24–26 | <0.5 |
| 2 (comp) | 70 AA/30 MAL | 30,000 | 30–34 | <0.5 |
| 3 (comp) | 100 MAL | 1,000 | 20–40 | >4 |
| 4A | 50 MAL/50 DIB | 4,570 | 14–16 | >4 |
| 4B | 50 MAL/50 DIB | 10,000 | 10–12 | >4 |
| 4C | 50 MAL/50 DIB | 15,100 | ~15 | ~2 |
| 5 | 40 MAL/60 LIM | 6,590 | ~18 | NA |
| 6 | 37 MAL/63 LIN | 2,340 | 10–20 | NA |
| 7A | 42 MAL/29 DIB/29 LIM | 3,500 | 18–20 | NA |
| 7B | 43 MAL/41 DIB/16 LIM | 7,290 | 10–20 | NA |
| 8 | 90 MAL/10 STY | 1,000 | 10–20 | >4 |

EXAMPLE 10

Compatibility with Liquid Detergent Formulations

The polymers of the present invention were added to a commercial liquid detergent formulation, initially at a level of 0.5% (0.5 in Table I) by weight on the commercial formulation, and increased to higher levels if compatibility was found.

Test conditions: "X" grams aqueous solution of LSD polymer ("X" based on polymer solids and desired test level) was added to "b 100-X" grams of commercial heavy duty liquid detergent. For example, to test an LSD polymer available as a 25% solids solution in water at the 0.5% compatibility level in a commercial formulation, one would take 2 grams of the LSD solution [2×0.25=0.51] and add it to 98 grams of the commercial formulation. If the same LSD polymer solution was to be tested at the 3% compatibility level, one would take 12 grams of the LSD solution [12×0.25=3] and add it to 88 grams of the commercial formulation. All compatibility tests were run on 25 gram portions of solution. The commercial heavy duty liquid detergent used was Ultra Vizir liquid detergent available from Proctor and Gamble France that contains "5–15% nonionic surfactant, 5–15% soap, 15–30% anionic surfactant, enzymes, optical brightener and less than 5% phosphonate."

The test formulations were observed for stability (compatibility or no phase separation) as a function of time, typically for at least 24–48 hours up to approximately 2 weeks. Compatibility is defined as maintenance of a stable solution, that is, no settling out of components or phase separation. As shown in Table I (last column), the polymers of the present invention (Examples 4 through 8) were more compatible in the commercial high surfactant-containing liquid detergent formulation than the acrylic acid homopolymer (Example 1) or the acrylic acid/maleic acid copolymer (Example 2). Compatibility values of 0.5, 2 and 4 in Table I refer to 0.5%, 2% and 4% by weight, respectively, of LSD polymer added to the commercial formulation.

A second commercial heavy duty liquid detergent was also used to evaluate compatibility of a polymer of the present invention. In this case, Example 4B had a compatibility of>4 when the commercial heavy duty liquid detergent used was Le Chat Compact liquid detergent (available from Henkel France containing "5–15% anionic surfactant, 5–15% soap, 15–30% non-ionic surfactant, enzymes and perfume").

EXAMPLE 11

Cleaning of Soiled Materials

An important characteristic of the cleaning process is the antiredeposition performance of the cleaning composition. Antiredeposition properties of a commercial heavy duty liquid detergent formulation together with several LSD polymers are presented in Table II. In addition to dispersing lime-soap deposits present in soiled materials to be cleaned, a satisfactory cleaning formulation should also prevent the dispersed or removed "soil" from redepositing onto the cleaned clothing, fabric or surface. A measure of antiredeposition is the whiteness index of cleaned fabrics; the higher the value, the better the antiredeposition property of the formulation. As shown in Table II, a polymer of the present invention was at least equal to or better than a conventional acrylic acid/maleic acid copolymer or maleic acid homopolymer in antiredeposition and did not reduce the cleaning efficiency of the commercial detergent formulation.

The cleaning test was performed as follows: Kenwood brand Mini-E washing machines were filled with 6 liters of tap water; calcium chloride and magnesium chloride were added to the water to yield 300 ppm hardness calculated as calcium carbonate ($Ca^{2+}/Mg^{2+}$=3/1). The washing machines were loaded with with approximately 500 grams of fabric (all-cotton terry fabric, cotton fabric and cotton/polyester blends). Then, 7.2 grams of soil (4.0 grams used motor oil and 3.2 grams potting soil) was added to the washing machine, followed by addition of the cleaning compositions being tested. The loads of soiled fabric were run for 5 complete wash cycles (30 minutes each) under warm conditions (40° C.), with the addition of soil and cleaning composition before each cycle. The cleaning compositions tested were made up as follows: commercial detergent: Ultra Vizir liquid detergent (described above, Example 10) charged to each load at 6 grams/liter of water; LSD polymer charged to each load at 2% by weight polymer solids based on weight of Ultra Vizir liquid detergent used.

Data in Table II are Whiteness Index values obtained from the laundered fabrics. The Whiteness Index was calculated as follows:

$$\text{Whiteness Index (WI)} = 3.387[Z] - 3[Y]$$

where Y and Z are reflectance values measured using a Pacific Scientific Colorimeter (Colorgard System 1000).

TABLE II

| Cloth | LSD Polymer Composition | Whiteness Index (WI) |
|---|---|---|
| Terry Cotton | None (comp) | 91–92 |
| | Example 2 (comp) | 96 |
| | Example 3 (comp) | 97 |
| | Example 4B | 97 |
| Cotton | None (comp) | 104–105 |
| | Example 2 (comp) | 107 |
| | Example 3 (comp) | 107–108 |
| | Example 4B | 108 |
| Polyester/Cotton | None (comp) | 86 |
| | Example 2 (comp) | 86 |
| | Example 3 (comp) | 87 |
| | Example 4B | 87 |

EXAMPLE 12

Cleaning of Soiled Materials

A second cleaning evaluation was conducted similarly to that described in Example 11 except that the commercial liquid detergent used was Le Chat Compact liquid detergent (described above, Example 10) instead of Ultra Vizir liquid detergent. As shown in Table III, a polymer of the present invention was at least equal to or better than the control (Le Chat Compact alone) or a conventional acrylic acid/maleic acid copolymer in antiredeposition performance on terry or cotton clothing, and significantly better than the control or the conventional acrylic acid/maleic acid copolymer on polyester/cotton clothing.

The cleaning test was performed as follows: Kenwood brand Mini-E washing machines were filled with 6 liters of tap water; calcium chloride and magnesium chloride were added to the water to yield 300 ppm hardness calculated as calcium carbonate ($Ca^{2+}/Mg^{2+}$=3/1). The washing machines were loaded with with approximately 500 grams of fabric (all-cotton terry fabric, cotton fabric and cotton/polyester blends). Then, 7.2 grams of soil (4.0 grams used motor oil and 3.2 grams potting soil) was added to the washing machine, followed by addition of the cleaning compositions being tested. The loads of soiled fabric were run for 10 complete wash cycles (30 minutes each) under warm conditions (40° C.), with the addition of soil and cleaning composition before each cycle. The cleaning compositions tested were made up as follows: commercial detergent: Le Chat Compact liquid detergent (described above, Example 10) charged to each load at 6 grams/liter of water; LSD polymer charged to each load at 0.5% by weight polymer solids based on weight of Le Chat Compact liquid detergent used. Data in Table III are Whiteness Index values obtained from the laundered fabrics.

TABLE III

| Cloth | LSD Polymer Composition | Whiteness Index (WI) Test A | Whiteness Index (WI) Test B |
|---|---|---|---|
| Terry Cotton | None (comp) | 84 | 83–84 |
| | Example 2 (comp) | 73–74 | NA |
| | Example 4B | 86 | 90–91 |
| Cotton | None (comp) | 96–97 | 102 |
| | Example 2 (comp) | 93 | NA |
| | Example 4B | 98 | 103 |
| Polyester/Cotton | None (comp) | 67–68 | 53 |
| | Example 2 (comp) | 58 | NA |
| | Example 4B | 79 | 83–84 |

We claim:

1. A method for preparing a liquid cleaning composition comprising combining:

(a) from 0.05 to 10 percent, based on total cleaning composition weight, of a lime-soap dispersant polymer comprising as polymerized units from 20 to 90 percent, based on total polymer weight, of maleic acid monomer selected from one or more of maleic acid, maleic anhydride and water-soluble salts thereof, and from 10 to 80 percent, based on total polymer weight, of a hydrophobe containing from 4 to 20 carbon atoms and selected from one or more of alkenes, dienes, alkynes and aromatic compounds;

(b) from 0.5 to 30 percent, based on total cleaning composition weight, of soap selected from one or more water-soluble salts of saturated and unsaturated ($C_8$–$C_{24}$)aliphatic carboxylic acids;

(c) from 0.1 to 60 percent, based on total cleaning composition weight, of auxiliary additives selected from one or more stabilizers, builders, and water-soluble anionic and non-ionic surfactants; and (d) water; adjusting the pH of the liquid cleaning composition to 5 to 11.5; maintaining the ratio of the lime-soap dispersant polymer to the soap from 1/1 to 1/200 by weight; and selecting the relative proportions of the lime-soap dispersant polymer, the soap, the auxiliary additives and the water in steps (a) through (d) such that the liquid cleaning composition is stable, and wherein the soap combined with the non-ionic and anionic surfactants is from 15 to 50 percent, based on total cleaning composition weight.

2. The method of claim 1 wherein the polymerized units of maleic acid monomer are from 30 to 60 percent and the polymerized units of hydrophobe are from 40 to 70 percent, based on total polymer weight.

3. The method of claim 1 wherein 0.1 to 4 percent of the lime-soap dispersant polymer is combined with 5 to 30 percent of the soap and with 10 to 50 percent of the non-ionic and anionic surfactant, based on total cleaning composition weight; and the lime-soap dispersant polymer to soap ratio is maintained at 1/2 to 1/20.

4. The method of claim 1 wherein the hydrophobe is selected from one or more of isobutylene, diisobutylene, styrene, decene, limonene, linalool and eicosene.

5. A liquid cleaning composition comprising:

(a) from 0.05 to 10 percent, based on total cleaning composition weight, of a lime-soap dispersant polymer comprising as polymerized units from 20 to 90 percent, based on total polymer weight, of maleic acid monomer selected from one or more of maleic acid, maleic anhydride and water-soluble salts thereof, and from 10 to 80 percent, based on total polymer weight, of a hydrophobe containing from 4 to 20 carbon atoms and selected from one or more of alkenes, dienes, alkynes and aromatic compounds;

(b) from 0.5 to 30 percent, based on total cleaning composition weight, of soap selected from one or more water-soluble salts of saturated and unsaturated ($C_8$–$C_{24}$)aliphatic carboxylic acids;

(c) from 0.1 to 60 percent, based on total cleaning composition weight, of auxiliary additives selected from one or more stabilizers, builders, and water-soluble anionic and non-ionic surfactants; and (d) water; wherein the soap combined with the non-ionic and anionic surfactants is from 15 to 50 percent, based on total cleaning composition weight; wherein the pH of the liquid cleaning composition is 5 to 11.5, the ratio of the lime-soap dispersant polymer to the soap is from 1/1 to 1/200 by weight; and wherein relative proportions of the lime-soap dispersant polymer, the soap, the auxiliary additives and the water are selected such that the liquid cleaning composition is stable.

6. The cleaning composition of claim 5 wherein the maleic acid monomer is maleic acid and comprises from 30 to 60 percent of polymerized units, and the hydrophobe is diisobutylene and comprises from 40 to 70 percent of polymerized units, based on total polymer weight.

7. The cleaning composition of claim 5 wherein the lime-soap dispersant polymer comprises from 0.1 to 4 percent, the soap comprises from 5 to 30 percent and the non-ionic and anionic surfactant comprises from 10 to 50 percent, based on total cleaning composition weight; and the lime-soap dispersant polymer to soap ratio is from 1/2 to 1/20.

8. A method for cleaning soiled materials comprising contacting a soiled material with the cleaning composition of claim 5 in an aqueous medium until substantial removal of soil is accomplished.

9. A solid bar cleaning composition comprising:

(a) from 0.05 to 10 percent, based on total cleaning composition weight, of a lime-soap dispersant polymer comprising as polymerized units from 20 to 90 percent, based on total polymer weight, of maleic acid monomer selected from one or more of maleic acid, maleic anhydride and water-soluble salts thereof, and from 10 to 80 percent, based on total polymer weight, of a hydrophobe containing from 4 to 20 carbon atoms and selected from one or more of alkenes, dienes, alkynes and aromatic compounds;

(b) from 0.5 to 50 percent, based on total cleaning composition weight, of soap selected from one or more water-soluble salts of saturated and unsaturated ($C_8$–$C_{24}$)aliphatic carboxylic acids; and (c) from 20 to 80 percent, based on total cleaning composition weight, of auxiliary additives selected from one or more neutral salts, builders, and water-soluble anionic and non-ionic surfactants; wherein the anionic and non-ionic surfactants are from 10 to 50 percent, based on total cleaning composition weight.

10. The solid cleaning composition of claim 9 wherein the composition is in a physical form selected from one or more of powder, granule, flake, tablet and bar.

11. A method for cleaning soiled materials comprising contacting a soiled material with the cleaning composition of claim 9 in an aqueous medium until substantial removal of soil is accomplished.

* * * * *